US006473990B1

(12) United States Patent
Trokhan et al.

(10) Patent No.: US 6,473,990 B1
(45) Date of Patent: Nov. 5, 2002

(54) NONCIRCULAR DRYING APPARATUS

(75) Inventors: Paul Dennis Trokhan, Hamilton, OH (US); Osman Polat, Montgomery, OH (US); Donald Eugene Ensign, Cincinnati, OH (US); Michael Gomer Stelljes, Jr., West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/929,607

(22) Filed: Aug. 14, 2001

(51) Int. Cl.[7] ..... F26B 3/00; F26B 13/00; F26B 13/06

(52) U.S. Cl. ..... 34/114; 34/335; 34/444; 34/618

(58) Field of Search ..... 34/114, 335, 444, 34/618

(56) References Cited

U.S. PATENT DOCUMENTS 1,666,472 A * 4/1928 Seybold ..... 162/368
3,432,936 A * 3/1969 Cole ..... 34/6
4,474,644 A * 10/1984 Poulsen ..... 162/199
4,583,302 A * 4/1986 Smith ..... 34/116
5,274,930 A * 1/1994 Ensign et al. ..... 34/23
5,437,107 A * 8/1995 Ensign et al. ..... 34/117
5,584,128 A * 12/1996 Ensign et al. ..... 34/117
5,942,322 A * 8/1999 Ensign et al. ..... 428/315.5
6,021,583 A * 2/2000 Stelljes et al. ..... 34/618
6,105,276 A * 8/2000 Ensign et al. ..... 34/453
6,158,144 A * 12/2000 Weber et al. ..... 34/335

* cited by examiner

*Primary Examiner*—Denise L. Esquivel
*Assistant Examiner*—K. B Rinehart
(74) *Attorney, Agent, or Firm*—David K. Mattheis; David M. Weirich; Ken K. Patel

(57) ABSTRACT

A micropore drying apparatus having a noncircular profile. The apparatus has a machine direction and dries a web thereon as the web or apparatus moves in the machine direction. The micropore drying apparatus comprises a micropore drying medium which has pores therethrough smaller than the interstitials in the web to be dried thereon. The micropore drying medium may be movable or stationary, as desired. The noncircular profile may have a major axis which is substantially vertically oriented. This arrangement provides the advantage that greater residence time for the web to be dried thereupon is provided, without increasing the machine direction footprint.

14 Claims, 5 Drawing Sheets

NONCIRCULAR DRYING APPARATUS

FIELD OF INVENTION

This invention relates to through air drying of cellulosic webs and more particularly to through air drying with noncircular drying arrangements.

BACKGROUND OF THE INVENTION

Through air drying is well known in the papermaking art. Through air drying is one means of removing water from an embryonic web comprising cellulose fibers. The following discussion is directed to tissue paper, although the invention is not so limited. The invention may be applied to any generally planar sheet material where it is desired to move air, or other compressible fluids, therethrough.

Through air drying has the advantage that structured paper, i.e., paper having regions which vary in density and having improved softness, caliper and absorbency, can be provided. Through air drying may be performed with one or more cylindrical through drying cylinders as illustrated by U.S. Pat. No. 4,953,297 issued Sep. 4, 1990 to Eskelinen et al; U.S. Pat. No. 5,411,636 issued May 21, 1993 to Hermans et al.; U.S. Pat. No. 5,601,871 issued Feb. 11, 1997 to Krzysik et al.; and European Pat. App. 0677612A2 published October 1995 in the names of Wendt et al. Capillary dewatering, using a cylindrical drying apparatus, is taught in commonly assigned U.S. Pat No. 4,556,450 issued Dec. 3, 1985 to Chuang et al., disclosure of which is incorporated herein by reference. Another generally cylindrical capillary dewatering apparatus is illustrated in U.S. Pat. No. 5,598,643 issued Feb. 4, 1997, U.S. Pat. No. 5,699,626 issued Dec. 23, 1997 and U.S. Pat. No. 5,701,682 issued Dec. 30, 1997, both to Chuang et al.

Another means of removing water from tissue paper is conventional felt drying. Conventional felt drying may also produce structured paper as illustrated by commonly assigned U.S. Pat. Nos. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; U.S. Pat. No. 5,861,082 issued Jan. 19, 1999 to Ampulski et al., U.S. Pat. No. 5,871,887 issued Feb. 16, 1999 to Trokhan et al.; U.S. Pat. No. 5,897,745 issued Apr. 27, 1999 to Ampulski, et al.; U.S. Pat. No. 5,944,811 issued May 18, 1999 to Ampulski et al.; and U.S. Pat. No. 6,051,105, issued Apr. 18, 2000 to Ampulski, incorporated herein by reference.

Improvements to the through air drying process have occurred through utilizing micropore drying. Micropore drying occurs when a micropore drying medium is disposed in the flow path of the through air drying apparatus. The micropore drying medium has flow channels smaller than the interstices between the fibers of the embryonic web.

Using micropore drying, the flow is controlled by the micropore drying medium, rather than by the web. Thus, differences in size of the web interstices—e.g., as occur with regions of differing density between various regions of the web—do not affect air flow through the web. Micropore drying thus provides the advantage of more uniform drying of structured paper. Examples of micropore drying are illustrated in commonly assigned U.S. Pat. Nos. 5,274,930; 5,437,107; 5,539,996; 5,581,906; 5,584,126; 5,584,128; and 5,625,961, the disclosures of which are incorporated herein by reference.

The micropore drying apparatus according to the present invention may comprise a single zone. This zone is maintained at a differential pressure (either subatmospheric or superatmospheric) which causes breakthrough in the interstitial flow channels, or pores, of the micropore drying medium. Alternatively, the micropore drying apparatus may comprise two or more zones. The first zone may be maintained at a differential pressure which does not cause breakthrough in the pores of the micropore drying medium. The second zone, as well as any subsequent zones, may be maintained at a differential pressure such that breakthrough does occur.

However, installing a through air drying roll or a micropore drying roll in an existing plant may be infeasible. Papermaking machinery is large. Typical rolls are several feet in diameter, heavy and expensive. Sufficient space for a cylindrical drying apparatus, such as a micropore drying roll, may not exist. Moreover, often, one cannot economically justify retrofitting a cylindrical roll into the papermaking machine—no matter how desirable the end result may be. The cost of the apparatus may not pay out over time.

Furthermore, if such a generally cylindrical apparatus is economically feasible today, it may not be economically justifiable tomorrow. As bottlenecks disappear due to improvements elsewhere in the papermaking machine, the papermaking process becomes faster. As the papermaking process becomes faster, the residence time on each component decreases. But, it is necessary to provide a sufficient residence time on each component of the papermaking machine—without increasing the space requirements of that component.

A cylindrical apparatus may not have sufficient diameter to provide the necessary residence time to achieve drying at commercially viable speeds.

This invention provides the benefit that increased residence time is obtained without increasing the horizontal space requirements of the papermaking machine. This invention further provides the benefit of being usable with a micropore drying apparatus.

SUMMARY OF THE INVENTION

The invention comprises an apparatus for drying a web thereon. The drying apparatus has a machine direction and a profile orthogonal thereto. The drying apparatus comprises a micropore drying medium having a noncircular profile.

The drying apparatus may comprise a movable micropore drying medium. In such an execution, the micropore drying medium may comprise an endless belt which carries a web to be dried thereon. Optionally, a through air drying belt may move in tandem with the micropore drying medium and the web to be dried.

In yet another execution, the micropore drying medium may be stationary. In such an execution, the web is carried by a separate support member such as a through air drying belt.

The machine directions of FIGS. 1 and 3–5 are indicated by the arrow.

DETAILED DESCRIPTION OF THE INVENTION

Figure 1:
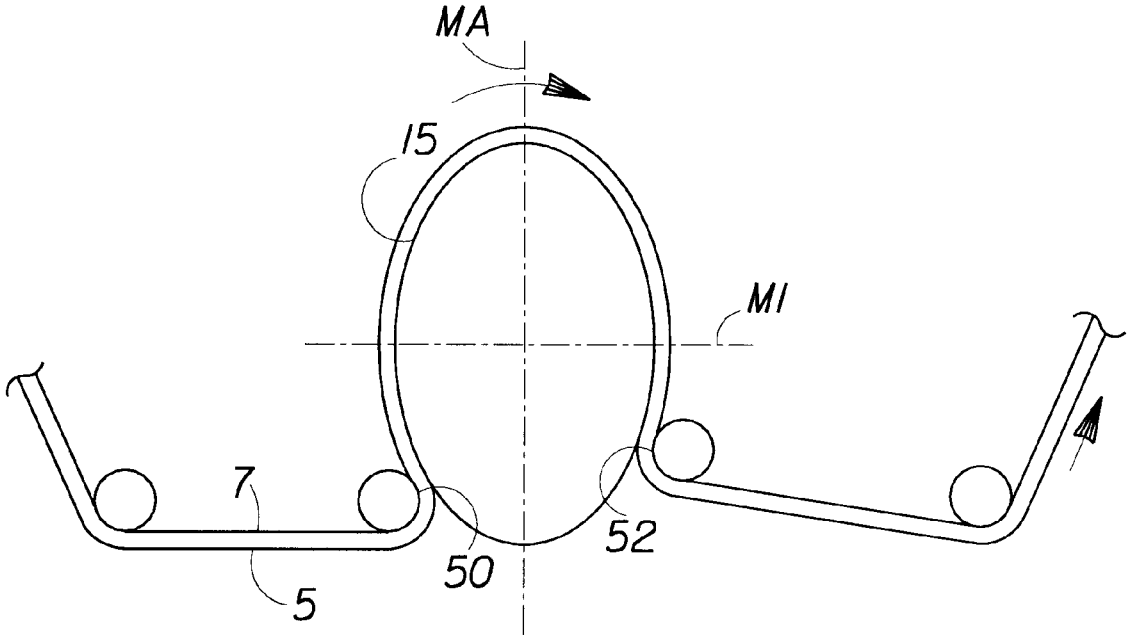
FIG. 1 is a schematic vertical side elevational view of a stationary apparatus according to the present invention having a generally vertically oriented major axis and a stationary micropore drying medium.

Referring to FIG. 1, the invention comprises an apparatus 10 for drying a web 5. The apparatus 10 comprises a support and a micropore drying medium 15. The web 5 and micropore drying medium 15 are movable relative to one another. In the embodiment of FIG. 1, the micropore drying medium 15 is stationary, and the web 5 to be dried is transported.

Figure 2:
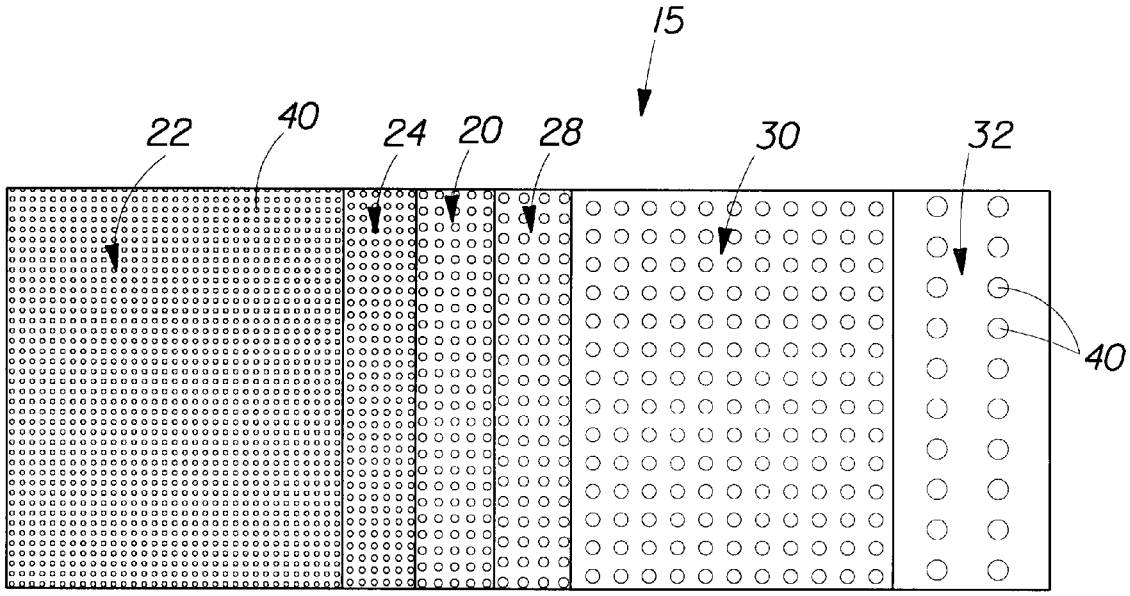
FIG. 2 is a schematic top plan view of the micropore drying medium according to the present invention.

Referring to FIG. 2, as used herein, a micropore drying apparatus 10 is any apparatus 10 which introduces a micropore drying medium 15 in the flow path of the through air drying process and the medium has a regular pattern of pores 40 which are smaller than the interstitials of the web 5 to be dried in the through air drying process. A suitable micropore drying apparatus 10 includes a laminate of one or more woven mesh screens, wherein at least one of the woven screens has openings, or pores 40, therethrough which are smaller than at least some, preferably a majority of, and more preferably all the interstitials of the web 5 to be dried thereon.

Examining the micropore drying medium 15 in more detail, the support according to the present invention may comprise a single ply or, preferably, a plurality of plies 22, 24, 26, 28, 30, 32 superimposed in face-to-face relationship. The ply(ies) 22,24,26,28,30,32 may be stationary. Each ply 22,24,26,28,30,32 is pervious to air flow therethrough. The plurality of plies 22, 24, 26, 28, 30, 32 may be arranged from a first, and preferably finest, ply 22 to a coarsest ply 32. Although it is desirable that the plies 22, 24, 26, 28, 30, 32 monotonically increase in pore 40 size from the 22 to the coarsest ply 32, such an arrangement is not required for the present invention. A preferred support comprises from three to eight plies 22, 24, 26, 28, 30, 32, and preferably from three to six plies 22, 24, 26, 28, 30, 32, as described below.

The first ply 22 contacts the aforementioned sheet 5 and carries it thereon. The plies 24, 26, 28, 30, 32 subjacent the first ply 22 provide strength and load carrying capability. Strength is important so that the micropore drying medium 15 may be transported across the support, undergo thermal cycling, and have a commercially useful life.

The plies 24, 26, 28, 30 intermediate the first ply 22 and the coarsest ply 32 provide a flow channel therebetween and support for the ply(ies) thereabove. It is preferable that each intermediate ply 24, 26, 28, 30 be able to provide both perpendicular and lateral fluid flow therethrough. Preferably, when the plies 22, 24, 26, 28, 30, 32 are considered as a unitary assembly, the micropore drying medium 15 exhibits a relatively low pressure drop therethrough and a relatively high bending fatigue strength.

The first ply 22 contacts the web 5 and carries the web 5 thereon as described above. The first ply 22 is typically the finest ply of the medium 15 and has pores 40 or other interstitial flow channels finer than the median size of the interstices in the web 5 to be dried. If the air flow direction is through the web 5 and into the support, preferably the pores 40 of the first ply 22 may have a nominal size of 120 microns or less, preferably a nominal size of 40 microns or less, more preferably 15 to 20 microns. If the direction of the air flow is outwardly from the support and then through the web 5, a larger pore 40 size may be utilized in the first ply 22. Pore 40 size is determined by SAE Standard ARP 901 issued Mar. 1, 1968 and incorporated herein by reference.

The first ply 22 according to the present invention may have a 165×1400 Dutch twill weave. A Dutch twill weave has both warps and shutes which pass over two and under two wires in each direction. A Dutch twill weave can be woven with small enough pores 40 to provide a limiting orifice for fluid flow therethrough as paper is dried thereon during papermaking. Also, a Dutch twill weave can be woven to provide a pore 40 size small enough for capillary dewatering to occur.

Alternatively, a square weave may prophetically be used for the first ply 22, although the pore 40 size may not be as small as desired. Alternatively, a broad mesh twill or broad mesh twill Z-Z weave may prophetically be used for the first ply 22. Such weaves are illustrated in the Haver and Boecker literature and in U.S. Pat. No. 4,691,744, issued Sep. 8, 1987 to Haver et al. and incorporated herein by reference.

The plies 24, 26, 28, 30, 32 subjacent the first ply 22 may each comprise a square weave. A square weave has warp and shute wires woven in a one over-one under pattern. In the degenerate case, the warp and shute wires have identical diameters. The mesh count of a square weave is the same in both directions. The flow path is straight through the square weave and in the directions perpendicular to the plane of that weaved. A square weave is preferred for the plies 24, 26, 28, 30 subjacent to first ply 22 because a square weave provides the best balance of air and/or two-phase fluid flow in the directions perpendicular to and lateral to the ply having the square weave. A Dutch twill weave can utilize larger diameter wires, providing strength for the coarser plies 24, 26, 28, 30, 32, a square weave of identical mesh count. Other types of weaves may be utilized, provided that the ply has sufficient air flow therethrough. Generally, it is preferred that none of the plies 24, 26, 28, 30, 32 subjacent to first ply 22 have a plain Dutch weave or a reverse Dutch weave. Such weaves tend to unduly restrict air flow through the ply. The first ply 22 comprises a Dutch twill weave. The plies 24, 26, 28, 30, 32 subjacent the first ply 22 may each comprise a square weave. All plies 22, 24, 26, 28, 30 have the specified mesh count and wire diameters. Table I below illustrates an exemplary support for use with the present invention.

TABLE I

| Ply | Warps/Shutes per 2.54 cm for plies 1–5 Perf Plate/Hole Size/Pitch for Ply 6 | Warp/Shute diameter (mm) for plies 1–5 Perf Plate Thickness for Ply 6 | Weave |
|---|---|---|---|
| 1 | 165 × 1400 | 0.071/0.041 | Dutch Twill |
| 2 | 150 × 150 | 0.066 | Square |
| 3 | 60 × 60 | 0.191 | Square |
| 4 | 30 × 30 | 0.406 | Square |
| 5 | 16 × 16 | 0.711 | Square |
| 6 | 1.65 mm diameter holes on a 2.77 mm pitch | 24 gauge ss | None |

The plies 22, 24, 26, 28, 30, 32 may be joined together to form a unitary support as follows. The first ply 22 is optionally calendered and the subjacent plies 24, 26, 28, 30, 32 are preferably individually calendered. The calendering must be sufficient to provide adequate knuckle area for the sintering operation described below without crimping the warps or shutes. The calendering must not unduly reduce the open area of the pores 40. The calendering may reduce the thickness of each ply 22, 24, 26, 28, 30 to approximately 65–85% of its original thickness. A considerable range of calendering levels may be utilized to provide the desired knuckle area. Knuckle area is important in providing adequate peel strength between the plies 22, 24, 26, 28, 30, 32.

The plies 22, 24, 26, 28, 30, 32 are then superimposed upon each other in the desired arrangement. As noted above, preferably but not necessarily, the plies 22, 24, 26, 28, 30, 32 are monotonically arranged in order from the smallest pore 40 size to the largest pore 40 size to form a laminate.

If desired, the pore 40 size may increase in the machine direction. This arrangement is thought to provide the benefit of more efficient operation during use. Preferred drying modules include the micropore drying apparatus 10 described in commonly assigned U.S. Pat. Nos. 5,274,930, issued Jan. 4, 1994 to Ensign et al.; U.S. Pat. No. 5,437,107, issued Aug. 1, 1995 to Ensign et al.; U.S. Pat. No. 5,539,996, issued Jul. 30, 1996 to Ensign et al.; U.S. Pat. No. 5,581,906, issued Dec. 10, 1996 to Ensign et al.; U.S. Pat. No. 5,584,126, issued Dec. 17, 1996 to Ensign et al.; U.S. Pat. No. 5,584,128, issued Dec. 17, 1996 to Ensign et al.; U.S. Pat. No. 5,625,961, issued May 6, 1997 to Ensign et al.; U.S. Pat. No. 5,912,072, issued Jun. 15, 1999 to Trokhan et al.; U.S. Pat. No. 5,942,322, issued Aug. 24, 1999 to Ensign et al.; and U.S. Pat. No. 6,105,276, issued Aug. 22, 2000 to Ensign et al., which patents are incorporated herein by reference.

The web 5 is generally macroscopically monoplanar, and may be fibrous. If fibrous, the web 5 may be synthetic, as is in the case of a nonwoven, may be cellulosic as is used for paper toweling, facial tissue, bath tissue, napkins, placemats, hard grades of paper, etc., or may be a combination thereof. The fibrous web 5 may also be a woven or knitted textile, as in the case of cloth.

The web 5 may be structured, i.e., have regions of different density and/or different basis weight. If the web 5 has regions of differing density, the web 5 may be made so that it comprises first regions of higher density and which are imprinted regions. The regions are imprinted against the framework of the belt 7, or against the framework of another belt 7 (not shown) which is used elsewhere in the manufacturing process.

Such a web 5 also has second regions comprising a plurality of discrete domes dispersed throughout the imprinted network region. The domes may correspond in geometry and position to deflection conduits in the framework of the belt 7. The domes protrude outwardly from the imprinted regions. The domes will generally be of lesser density than the imprinted region. The imprinted region may, in a preferred embodiment, be essentially continuous as noted above and the domes discrete. Alternatively, the imprinted regions and domes may be semi-continuous as is known in the art. Or the imprinted regions may be discrete and the domes continuous. A suitable structured web 5 may be made according to any of commonly assigned U.S. Pat. Nos. 4,529,480, issued Jul. 16, 1985 to Trokhan; U.S. Pat. No. 4,637,859, issued Jan. 20, 1987 to Trokhan; U.S. Pat. No. 5,364,504, issued Nov. 15, 1994 to Smurkoski et al.; and U.S. Pat. No. 5,529,664, issued Jun. 25, 1996 to Trokhan et al., U.S. Pat. No. 5,679,222 issued Oct. 21, 1997 to Rasch et al., and U.S. Pat. No. 5,714,041 issued Feb. 3, 1998 to Ayers et al., the disclosures of which are incorporated herein by reference.

If desired, the structured web 5 may have multiple basis weights. If such a web 5 is desired, it preferably has an essentially continuous network comprising a high basis weight region and discrete low basis regions disbursed throughout the essentially continuous network high basis weight region. The web 5 may comprise an intermediate basis weight region as well. Optionally, any of these regions may be selectively densified at various locations. A suitable multi-basis weight web 5 may be made according to any of commonly assigned U.S. Pat. No. 5,245,025, issued Sep. 14, 1993 to Trokhan et al.; U.S. Pat. No. 5,277,761, issued Jan. 11, 1994 to Phan et al.; U.S. Pat. No. 5,443,691, issued Aug. 22, 1995 to Phan et al.; U.S. Pat. No. 5,527,428, issued Jun. 18, 1996 to Trokhan et al., U.S. Pat. No. 5,534,326, issued Jul. 9, 1996 to Trokhan et al.; U.S. Pat. No. 5,564,076, issued Aug. 5, 1997 to Trokhan et al.; U.S. Pat. No. 5,804,036, issued Sep. 8, 1998 to Phan et al.; U.S. Pat. No. 5,804,281, issued Sep. 8, 1998 to Phan et al.; and U.S. Pat. No. 5,820,730, issued Oct. 13, 1998 to Phan et al., the disclosures of which are incorporated herein by reference.

Figure 4:
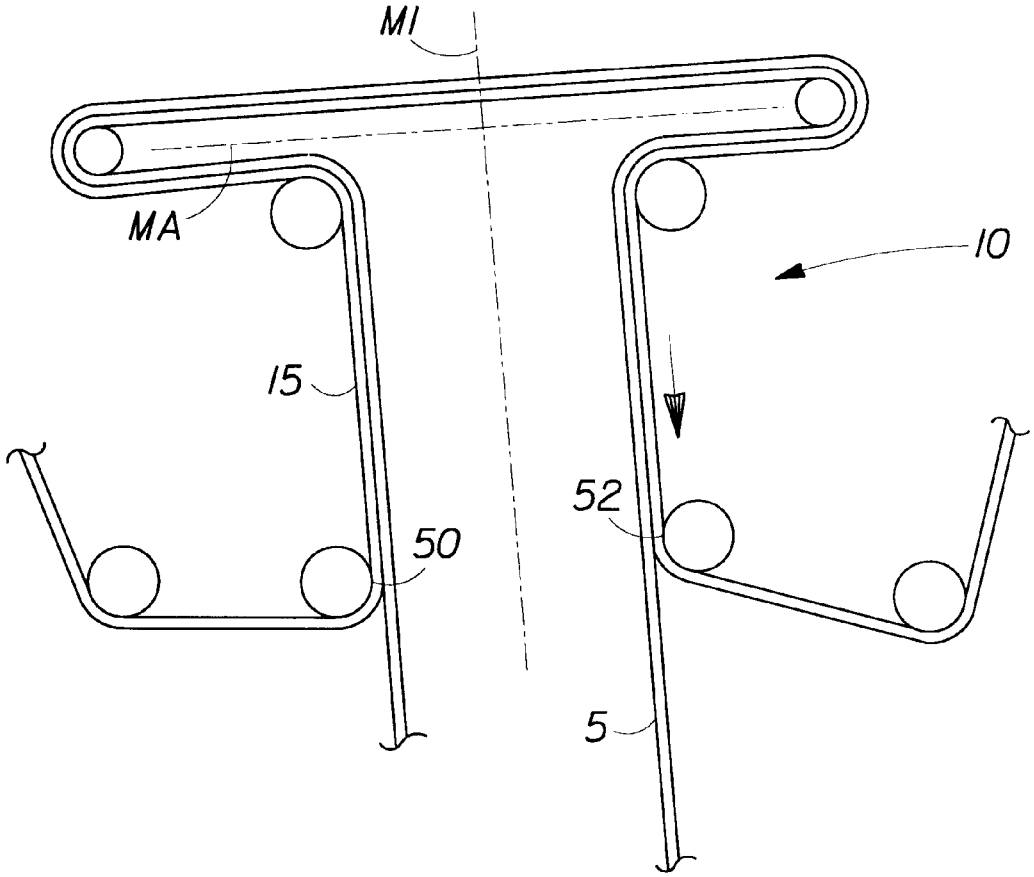
FIG. 4 is a schematic side elevational view of a stationary apparatus similar to that illustrated in FIG. 3 having only a single inlet and exit to the drying module. The apparatus of FIGS. 3–4 have micropore drying media which are movable in the machine direction. The major axis of the apparatus of FIG. 4 is generally horizontally oriented.

Referring to FIGS. 1 and 4, if the micropore drying medium 15 is held stationary, the web 5 to be dried may be transported relative to the stationary medium 15 by a belt 7. Preferably the belt 7 is a through air drying belt 7 as is well known in the art. By transporting the web 5 on a through air drying belt 7, the web 5 may be interposed between the through air drying belt 7 and the micropore drying medium 15. Preferably the web 5 and through air drying belt 7 move in tandem, so that there is not relative motion therebetween. Relative motion may cause tearing of the web 5. If such an embodiment is selected, preferably the direction of the air flow is outward. That is to say the air flow first passes through the micropore drying medium 15, then web 5, and finally through air drying belt 7 in the radially outward direction. By passing air flow in this direction, relative motion and hence occurrences of abrasion, tearing or major disruption of the web 5 against the micropore drying medium 15 is reduced. Further, lift-off of the web 5 relative to through air drying belt 7 is minimized.

The belt 7 used to carry the web 5 may be made of any construction which provides for air flow therethrough. Preferably the belt 7 comprises a patterned framework so that an imprinted region occurs on the web 5 as described above. The framework may be made of photosensitive resin or any other material which imprints the paper. Suitable belts 7 may be made according to co only assigned U.S. Pat. No. 3,301,746, issued Jan. 31, 1967 to Sanford et al.; U.S. Pat. No. 3,905,863, issued Sep. 16, 1975 to Ayers; U.S. Pat. No.

4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876 issued May 13, 1997 to Ayers et al.; U.S. Pat. No. 5,679,222 issued Oct. 21, 1997 to Rasch et al.; and U.S. Pat. No. 5,714,041 issued Feb. 3, 1998 to Ayers et al., the disclosures of which are incorporated herein by reference.

The belt 7, and any web 5 carried thereupon, travel in the machine direction through, to, from or across the various modules in the manufacturing process, and particularly in a papermaking process as noted above. Exemplary and non-limiting modules in a typical papermaking machine include conventional press felt drying modules, through air drying modules, and other drying modules. Other suitable modules include coating modules where lotions, softeners, medicaments, perfumes, dies, visual indicia and other functional additives may be applied. Of most, but not exclusive, interest for the invention described herein is a drying module, particularly a through air drying module.

A module may be considered to have an inlet 50 and an exit 52. The inlet 50 is the point in the module, taken in the machine direction, where the module first begins to functionally affect the belt 7 and/or web 5. Likewise, the exit 52 to the module is the last point, taken in the machine direction, at which the module functionally affects the belt 7 and/or web 5 in the same or similar manner.

The micropore drying medium 15, belt 7, and the web 5 carried thereupon, are each generally planar. Each defines an X-Y plane. Perpendicular to the X-Y planes of the micropore drying medium 15, the belt 7 and the web 5 are the Z-axes of the micropore drying medium 15, belt 7 and web 5, respectively. The thickness of the micropore drying medium 15, belt 7 and the web 5 are measured in the Z-direction.

The belt 7, and any web 5 carried thereupon, travel in the machine direction through the apparatus 10 of the present invention. The machine direction lies within the aforementioned X-Y planes. Transverse to the machine direction and lying within the X-Y planes are the cross machine directions of the belt 7 and web 5, respectively. Perpendicular to the machine direction and to the XY plane is the profile of the apparatus 10 of the present invention.

The belt 7, and micropore drying medium 15 may be mounted upon a support. The support preferably remains stationary and may include any structure known in the art for the purpose of allowing transport of the web 5 in the machine direction. Typical supports include a frame, cantilevered rolls, rolls supported at both ends, and other well known structures which allow for movement of the belt 7 and web 5 in the machine direction. Exemplary and non-limiting supports are illustrated in commonly assigned U.S. Pat. No. 5,637,194, issued Jun. 10, 1997 to Ampulski et al.; U.S. Pat. No. 5,629,052 issued May 13, 1997 to Trokhan et al.; and U.S. Pat. No. 5,185,052 issued Feb. 9, 1993 to Chappell et al., which patents are incorporated herein by reference. The rolls may be drive rolls or driven rolls, as are known in the art.

Generally, prior art modules were circular in shape, typically having a diameter from 1 to 6 meters. The papermaking belt 7 typically subtended a sector spanning more than 180° of that module. The greater the angle subtended by the belt 7 the greater the residence time on that module at a constant rate. If one wished to increase the residence time, it was necessary to either slow the machine direction speed of the belt 7 or to increase the diameter of the roll used in that module. Neither alternative is attractive from a cost standpoint.

The web 5 path through the apparatus 10 of the present invention has a noncircular shape. The noncircular shape of the web 5 path occurs as the web 5 path is viewed in profile relative to the machine direction.

Referring still to FIG. 1, the support of the present invention provides a path through the module which is noncircular, i.e., has a variable radius. A path of infinite radius, i.e., generally straight, is included within the scope of the present invention. Because the path of the support is noncircular, it may provide for greater residence time than is achievable with a circular module. The noncircular path for the web 5 is coincident the subtended portion of the noncircular micropore drying medium 15. The module may have a major axis MA-MA. The major axis MA-MA is the principal orientation of machine direction travel between the inlet 50 and exit 52 of that module. The minor axis MI-MI is perpendicular to both the major axis MA-MA and the cross machine direction.

Figure 3:
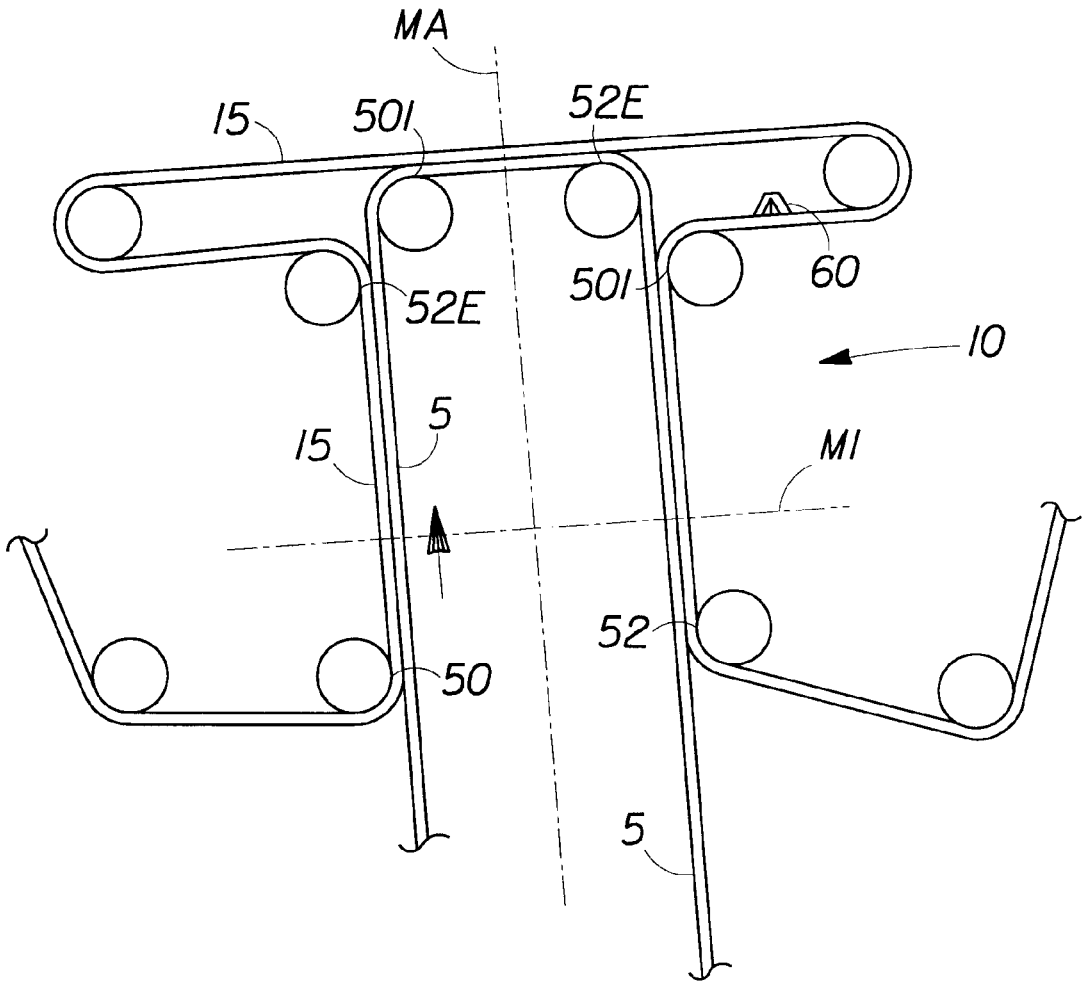
FIG. 3 is a schematic side elevational view of an apparatus according to the present invention having a T-shaped profile, an inlet and an exit, and a plurality of module sub-inlets and sub-exits. The web is disposed internal to the micropore drying medium.
Figure 5:
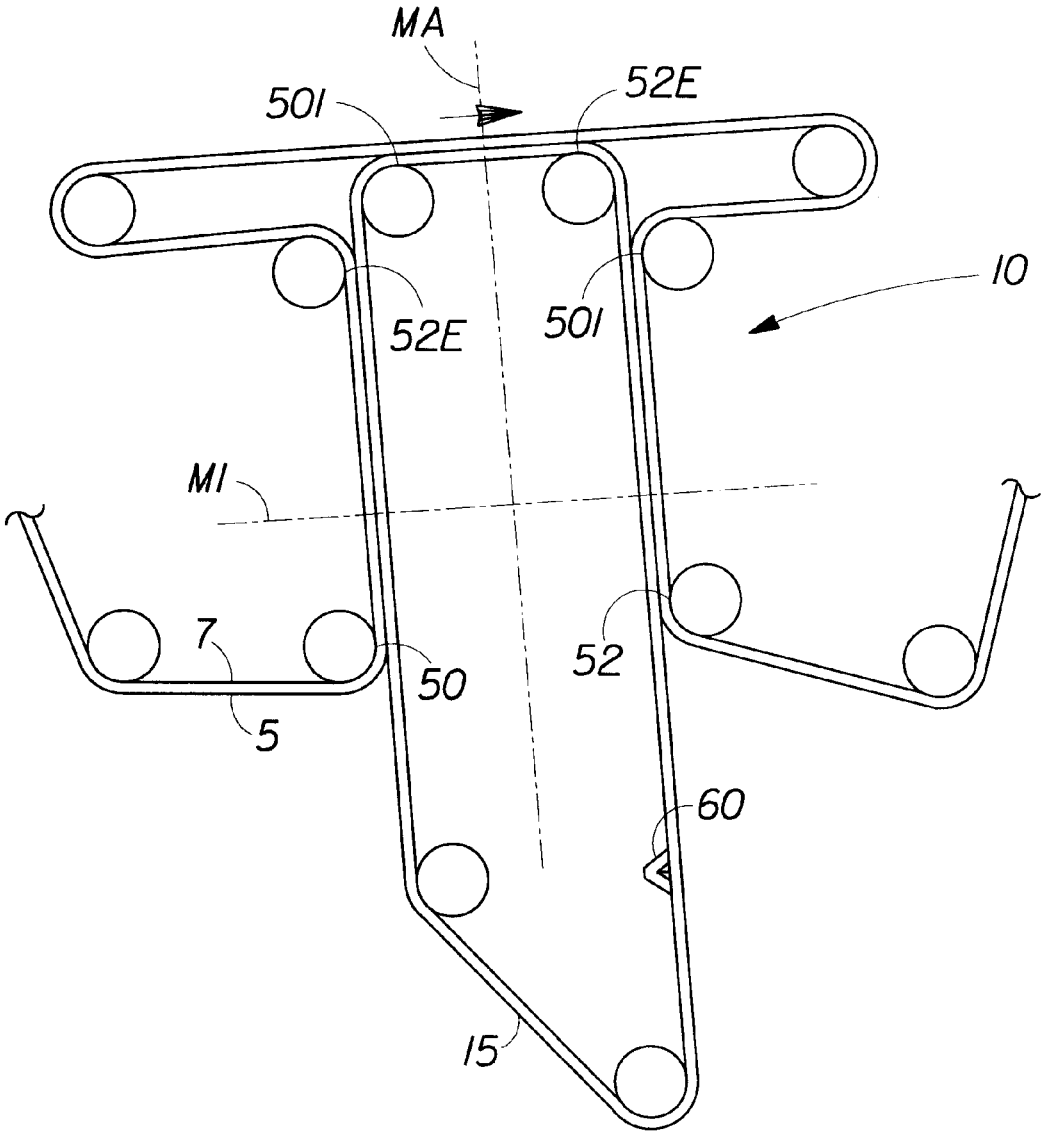
FIG. 5 is a vertical side elevational view of an apparatus according to the present invention showing a movable micropore drying medium disposed in the form of an endless loop. The web to be dried is carried upon an optional belt.

Referring to FIGS. 1, 3 and 5, the major axis MA-MA may be vertically oriented and provide residence time as the optional belt 7 and web 5 travel both vertically upwards and vertically downwards. This arrangement provides for a path, and hence residence time, limited only by the vertical space constraints of the area in which the support is housed. This arrangement further provides the benefit of increased residence time within the module without dedicating undue floor space or requiring a footprint which takes up too much space in the machine direction.

The major axis MA-MA need not be coincident the vertical, but simply substantially vertically oriented. By substantially vertically oriented, it is meant that the major axis MA-MA has an orientation within ±45° of the vertical.

Referring to FIGS. 3–5, one of ordinary skill will recognize that at the apogee of the vertical travel, the belt 7 and web 5 need not immediately return towards the exit 52 of the module. Juxtaposed with the apogee, the support may provide for a path having a hemispherical distal geometry, a mushroom-shaped distal geometry, a T-shaped distal geometry as shown below, or any other geometry which capitalizes on space which may be available above adjacent modules. Of course, one of ordinary skill will recognize that other suitable shapes and paths of machine direction travel through the module may be utilized as well. For example, a festoon system may be utilized.

According to the present invention, the major axis MA-MA may range from 1 meter to 20 or more meters, limited only by the space constraints available to retrofit the invention into existing machinery, or into the space constraints of a new papermaking installation.

The present invention is applicable to stationary micropore drying media 15 wherein the web 5 moves relative to the micropore drying medium 15, as well as movable micropore drying media 15 wherein the web 5 does not move relative to the micropore drying medium 15 while juxtaposed therewith. It will be readily appreciated that air flow through the web 5 may occur in either direction such that the air flow is first through the micropore drying medium 15 and then through the web 5, or vice versa.

For example, referring to FIG. 3, the module may comprise a stationary micropore drying medium 15 having a T-shape. Such a module has only one principal inlet 50 and exit 52. However, the module may include a number of sub-inlet 50I and sub-exit 52E combinations. Alternatively, the micropore drying medium 15 in the embodiment of FIG. 3 may be movable, and move in tandem with the web 5. This arrangement provides the advantage that one or more optional showers 60 may be disposed in the portions of the micropore drying medium 15 which do not have the web 5 disposed in face-to-face relationship therewith.

Referring to FIG. 4, if desired, the web 5 may track the noncircular profile of the micropore drying medium 15 without interruption throughout the entire module, i.e., from the inlet 50 to the exit 52. This arrangement provides the benefit of greater contact length, and hence greater residence time, of the web 5 with the micropore drying medium 15 or other functional portions of that module.

Of course, one of ordinary skill will recognize that an optional through air drying belt 7 may be included in either the module of FIG. 3 and/or FIG. 4. The drying belt 7 will carry the web 5 thereon and reduce the occurrence of breakage of the web 5. Further, one of ordinary skill will recognize that while asymmetrical configurations are illustrated for the apparatus 10 shown in FIGS. 3–4, symmetrical configurations are easily envisioned and within the scope of the claimed invention.

FIG. 5 illustrates an arrangement similar to that of FIG. 3, but having the micropore drying medium 15 disposed in the form of an endless belt. The endless belt comprising the micropore drying medium 15 is disposed generally internal to the web 5. Additionally, FIG. 5 illustrates an embodiment wherein the web 5 is carried by a through air drying belt 7. At the positions between the inlet to the module 50 and the sub-module exit 52*e*, as well as the sub-module inlet 50I and 52E and sub-module inlet 50I and module exit 52, the belt 7, web 5 and micropore drying medium 15 are all disposed in face-to-face relationship.

One of ordinary skill will recognize that at these positions where the belt 7, web 5 and micropore drying medium 15 are disposed in face-to-face relationship, air may be blown through these components in succession in either an inward or outward direction. If the air is drawn internal through to the apparatus 10 of FIG. 5, the air would be drawn first through the through air drying belt 7, then the web 5, and finally through the micropore drying medium 15. However, it will be apparent to one of ordinary skill that the apparatus 10 of FIG. 5 may have the air blow outwardly, through the micropore drying medium 15, the web 5, and the through air drying belt 7 in succession. Such an arrangement is possible because the through air drying belt 7 supports the web 5, preventing separation of the web 5 from the micropore drying medium 15.

Likewise, if the optional through air drying belt 7 was included with the apparatus 10 of the embodiments of FIGS. 3–4, the outflow arrangement discussed above would be feasible.

If desired, a roll (not shown) may be used to lightly press the web 5 against the micropore drying medium 15. A roll to lightly press the web 5 against the micropore drying medium 15 may be juxtaposed with the inlet 50 of the micropore drying apparatus 10. Lightly pressing a web 5 against a roll is generally described in U.S. Pat Nos. 5,598,643, 5,701,682 and 5,772,845.

Lightly pressing a web 5 against a noncircular micropore drying medium 15 provides the advantage that increased residence time under pressure can be obtained without unduly increasing the size of the micropore drying apparatus 10. More specifically, as the diameter of a circular micropore drying apparatus 10 increases, the residence time under pressure will proportionately increase. However, a larger radius of curvature may be selectively utilized at the point where the roll (not shown) lightly presses the web 5 against a noncircular micropore drying apparatus 10. This geometry obviates the need for a large diameter circular micropore drying medium 15 throughout the entirety of the geometry—specifically those areas not subtended by the light pressing effect.

If desired, the micropore drying medium 15 may comprise variable pore 40 sizes. By variable pore 40 sizes, it is meant that the smallest pore 40 size at any point in the flow path may be sized greater than, or less than, the finest pore 40 size at another point in the flow path, which points are spaced apart in the machine direction. A variable pore size 40 may be accomplished by, for example, having different weaves in the first lamina 22. Typically, one of ordinary skill would desire the pore 40 size to increase in the machine direction. Alternatively, one of ordinary skill may wish to otherwise change the wet pressure drop of flow through the micropore drying medium 15. This may be otherwise accomplished by changing the density of the pores 40, providing a low surface energy coating on the micropore drying medium 15, etc.

If desired, the web 5 and belt 7 may be interposed in face-to-face relationship between two micropore drying media 15. This arrangement could provide particular benefits if the pores 40 of one medium 15 are held at a pressure less than the breakthrough pressure of the pores 40. The micropore drying medium 15 in contact with the belt 7 provides the benefit of removing moisture from the belt 7 if there is not a hydraulic connection between the water in the belt 7, and the capillaries of the web 5. Water that is not removed from the belt could subsequently rewet the web 5.The micropore drying medium 15 juxtaposed in face-to-face relationship with the backside of the belt 7 may have larger pores 40, depending upon the size of the capillary pores in the belt 7, than the pores 40 of the micropore drying medium 15 in contact with the web 5. Alternatively, one of ordinary skill may wish to use such an arrangement with identical micropore drying media 15 on both sides of the web 5 and belt 7. This arrangement would prophetically reduce occurrences of water being moved from one side of the belt 7/web 5 interface to the other, without providing for effective removal.

Additionally, two or more micropore drying apparatus 10 according to the present invention may be utilized in series, and spaced apart in the machine direction. If desired, the different micropore drying apparatus 10 may include apparatus 10 of constant pore 40 size, variable pore 40 size, circular profile, noncircular profile according to the present invention, and various combinations thereof, all of which are within the scope of the appended claims.

Using the micropore drying apparatus 10 of the present invention, the web 5 may be dried without the use of a Yankee dryer drum and/or without further compaction of the web 5. By "further compaction of the web", it is meant compaction of the web 5 which occurs after the web 5 is removed from the micropore drying apparatus 10. Further compaction of the web 5 does not include any compaction incidental to the step of lightly pressing the web 5 as described above. By drying the web 5, it is meant that the web 5 is dried to a consistency of at least 90%.

A belt 7 which has been cited in the literature as suitable for use without further compaction of the web 5 comprises a Jacquard or similar weave. Belts 7 having such weaves are illustrated in U.S. Pat. Nos. 5,429,686 issued Jul. 4, 1995 to Chiu et al. and 5,672,248 issued Sep. 30, 1997 to Wendt et al., which patents are incorporated herein by reference.

In the description of the invention, various embodiments and/or individual features are disclosed. All combinations of such inventions and features are possible and can result in preferred executions of the invention.

What is claimed is:

1. A micropore drying apparatus for drying a web thereon, the apparatus having a machine direction and a profile orthogonal thereto, the micropore drying apparatus comprising a stationary micropore drying medium, the micropore drying medium having a noncircular profile.

2. A micropore drying apparatus according to claim 1, wherein the profile has a major axis and a minor axis, the major axis being greater than the minor axis, wherein the major axis is generally vertically oriented.

3. A micropore drying apparatus according to claim 2 having a variable pore size.

4. A micropore drying apparatus according to claim 3, wherein the pore size increases in the machine direction.

5. A micropore drying apparatus according to claim 1, further comprising a through air drying belt for carrying the web and for disposing the web in face-to-face relationship with the micropore drying medium, the belt and the web being movable together and being transportable relative to the stationary micropore drying medium.

6. A micropore drying apparatus according to claim 5, wherein the through air drying belt comprises a Jacquard weave.

7. A micropore drying apparatus according to claim 5, wherein the through air drying belt comprises photosensitive resin.

8. A micropore drying apparatus according to claim 6, wherein the micropore drying apparatus successively blows air through the micropore drying medium, the web and the through air drying belt.

9. A process for removing water from a web, the process comprising the steps of:

providing a micropore drying apparatus having a movable micropore dying medium, the movable micropore drying medium moving in a machine direction and having a noncircular profile orthogonal to the machine direction;

placing the web to be dried on the micropore drying medium;

transporting the web and the micropore drying medium together in face-to-face relationship without relative motion therebetween in the machine direction; and passing air through the web and the micropore drying medium while being transported providing a through air drying belt, the through air drying belt carrying the web thereon, the through air drying belt being disposed in face-to-face relationship with the web whereby the web is interposed between the through air drying belt and the micropore drying medium, the web, the through air drying belt, and the micropore drying medium being transportable in the machine direction without relative movement therebetween.

10. A process according to claim 9, further comprising the step of lightly pressing the web against the micropore drying medium.

11. A process according to claim 9, further comprising the step of interposing the through air drying belt and the web in face-to-face relationship between two micropore drying media, wherein one of the micropore drying medium is disposed in face-to-face relationship with the web and the other of the micropore drying medium is disposed in face-to-face relationship with the through air drying belt.

12. A process for removing water from a web of tissue paper, the process comprising the steps of:

providing a drying apparatus having a micropore drying medium, said drying apparatus having a machine direction and a noncircular profile orthogonal to said machine direction, providing a through air drying belt movable in the machine direction, placing the web of tissue paper to be dried in face-to-face relationship with the through air drying belt, placing the web of tissue paper to be dried and through air drying belt in face-to-face relationship with the stationary micropore drying medium, wherein the web of tissue paper is interposed between the micropore drying medium and the through air drying belt, moving the through air drying belt and the web of tissue paper without relative motion therebetween relative to the micropore drying medium, passing air through the micropore drying medium, the web of tissue paper, and the through air drying belt, to remove moisture from the web of tissue paper, and drying the web of tissue paper without further compaction of the web.

13. A process according to claim 12, wherein the step of passing air through the micropore drying medium, the web of tissue paper, and the through air drying belt comprises passing air through the micropore drying medium, the web of tissue paper, and the through air drying belt in succession.

14. A process according to claim 12, wherein the step of drying the tissue paper without further compaction of the web of tissue paper comprises the step of drying the tissue paper without the use of a Yankee drying drum.

* * * * *